United States Patent [19]

Eheim

[11] Patent Number: 4,459,957

[45] Date of Patent: Jul. 17, 1984

[54] FUEL INJECTION PUMP

[75] Inventor: Franz Eheim, Stuttgart, Fed. Rep. of Germany

[73] Assignee: Robert Bosch GmbH, Stuttgart, Fed. Rep. of Germany

[21] Appl. No.: 123,535

[22] Filed: Feb. 22, 1980

[30] Foreign Application Priority Data

Mar. 12, 1979 [DE] Fed. Rep. of Germany ..... 2909588

[51] Int. Cl.[3] ..... F02D 17/06

[52] U.S. Cl. ..... 123/387; 123/179 L; 123/373

[58] Field of Search ..... 123/366, 368, 372, 387, 123/179 L, 502, 373

[56] References Cited

U.S. PATENT DOCUMENTS

| | | | |
|---|---|---|---|
| 2,895,465 | 7/1959 | Humber | 123/366 |
| 3,096,747 | 7/1963 | Tado | 123/502 |
| 3,443,554 | 5/1969 | Kleeberger | 123/387 |
| 3,814,072 | 6/1974 | Gillespie | 123/366 |
| 4,180,040 | 12/1979 | Hofer | 123/368 |
| 4,278,058 | 7/1981 | Berner | 123/387 |
| 4,403,583 | 9/1983 | Eheim | 123/366 |

*Primary Examiner*—Parshotam S. Lall
*Assistant Examiner*—Carl Stuart Miller
*Attorney, Agent, or Firm*—Edwin E. Greigg

[57] ABSTRACT

The invention relates to a fuel injection pump having a governor which functions in accordance with rpm, wherein springs engage an adjusting member, of which one spring acts as the starting spring and at least a second available spring acts as the governor spring upon the adjusting member via a spring plate, the springs being supported, however, at least in the outset position, on the housing via the adjusting piston.

12 Claims, 7 Drawing Figures

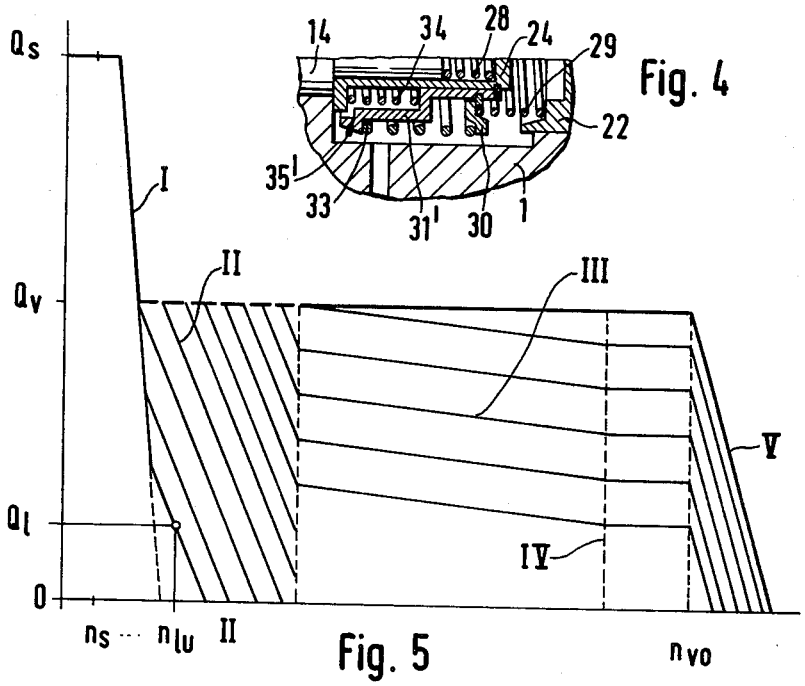
Fig. 4
Fig. 5
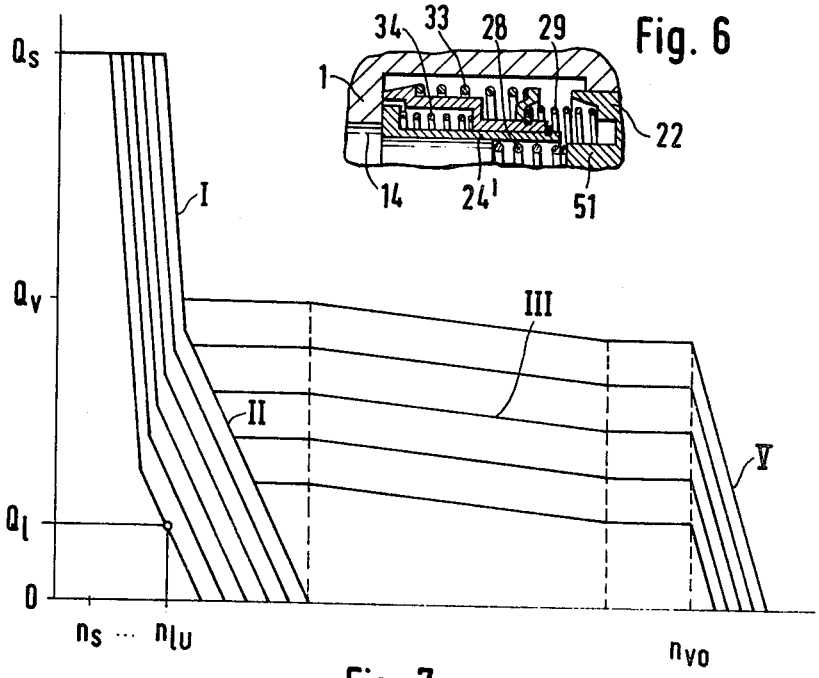
Fig. 6
Fig. 7

FUEL INJECTION PUMP

BACKGROUND OF THE INVENTION

The invention relates to a fuel injection pump for internal combustion engines. In a known fuel injection pump of this type, the more yielding spring acts as the idling spring, while the stiffer spring acts as the final rpm spring. The governor spring acts, via a spring plate and the idling spring switched in series therewith, upon the adjustment member, whereupon the stroke performed by the governor spring while in the relaxed state is not restricted in the fashion of a stop. This places demands on the producers of springs which are difficult to be fulfilled, because despite identical forces and equally stiff springs, the length of the spring block in the relaxed state varies slightly. This variation, however, signifies a change in the initial length of the idling spring, with a corresponding change in the control of idling. The control of starting quantities must be accomplished via complicated lever-type transfer of motion. Furthermore, in this known governor, the function is directed quite strictly to one particular type of governor, so that it is possible to make only very limited application of the fuel injection pump equipped with this governor.

OBJECT AND SUMMARY OF THE INVENTION

The fuel injection pump in accordance with the invention has the advantage over the prior art that a governor with an inexpensive, compact design is created, in which the starting spring is integrated with the governor packet. As a result of the avoidance of lever-type transfers of motion, it is possible to attain relatively long travel paths, and thus very precise orientation of the travel paths. Through a simple exchange of the sets of springs, the governor can be embodied as an idling end governor or as an adjusting governor, and the most various functions, such as adjustment and the like, can be integrated therein without enlarging the structural form.

The invention will be better understood and further objects and advantages thereof will become more apparent from the ensuing detailed description of preferred embodiments taken in conjunction with the drawings.

BRIEF DESCRIPTION OF THE DRAWINGS

FIGS. 4 and 5 show an idling end governor with an adjustment in the partial-load range only; and FIGS. 6 and 7 show an idling end governor with adaptation in the full-load range as well, and with a starting spring switched parallel to the other springs.

DESCRIPTION OF THE PREFERRED EMBODIMENTS

Figure 1:
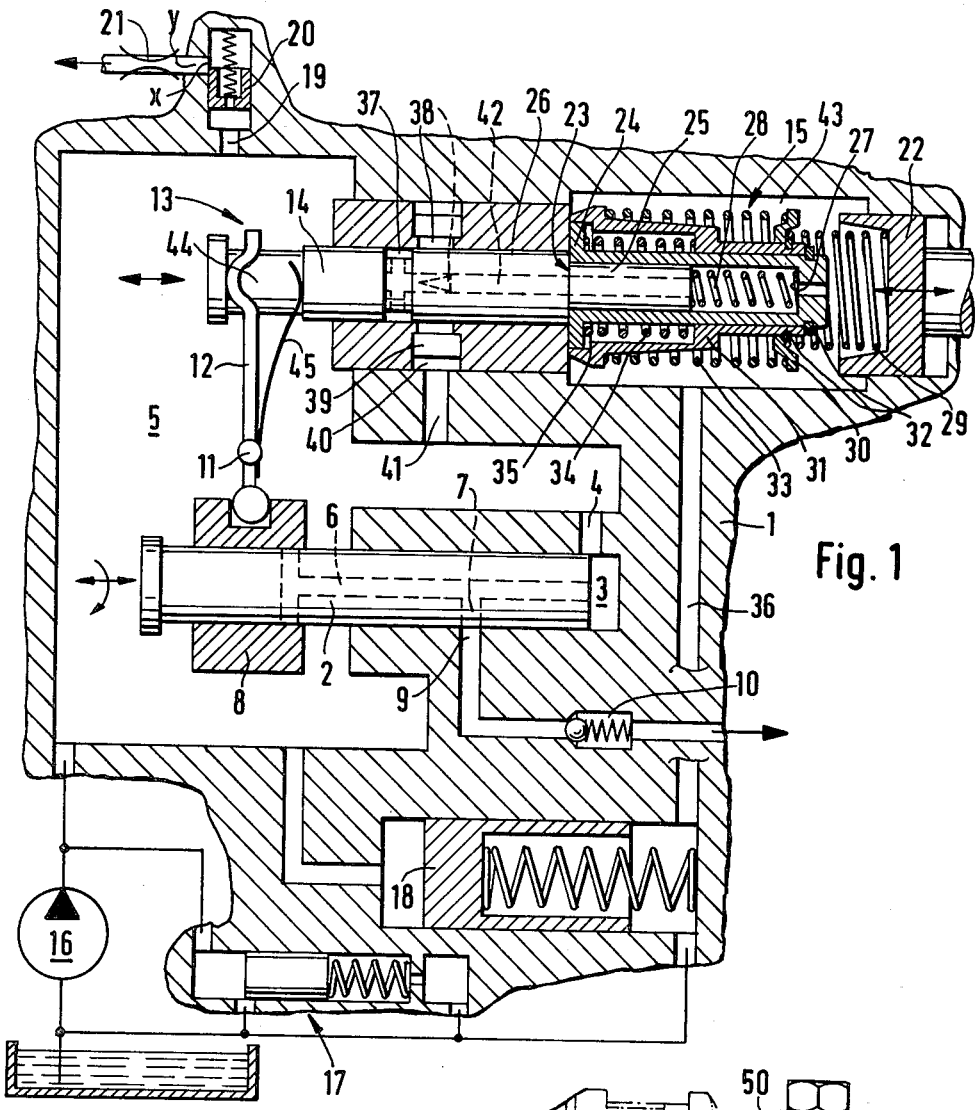
FIG. 1 shows a fuel injection pump in accordance with the invention and having an idling end governor, in simplified form and in a longitudinal cross-sectional view.

In FIG. 1, a fuel injection pump in accordance with the invention is shown in greatly simplified form. A pump piston 2 moves within a housing 1 of this fuel injection pump, being set into simultaneously reciprocating and rotary motion by a cam drive which is not shown but represented by the two arrows. The pump piston 2 defines a pump work chamber 3 in the housing 1 which communicates via an inflow channel 4 with the pump suction chamber 5 disposed in the housing 1. A pressure channel 6 is disposed in the pump piston 2, is arranged to discharge into the pump work chamber 3, and has a distributor bore 7 which branchs off from it. This pressure channel is controlled by an annular slide 8 acting as the fuel quantity control member. The distributor bore 7 cooperates with pressure lines 9, which are distributed generally uniformly about the pump piston and each of which contains a check valve 10. During the suction stroke of the pump, fuel proceeds out of the suction chamber 5, via the inflow channel 4, and into the pump work chamber 3. During the subsequent compression stroke of the pump piston 2, the fuel, which is under high pressure after the closing of the inflow channel 4 via the distributor bore 7, is carried to one of the pressure lines 9, in order to proceed thereby and via a fuel injection valve (not shown) into a cylinder of the internal combustion engine being supplied. After an appropriate compression stroke has been performed, the pressure channel 6 in the pump piston 2 is opened by the annular slide 8 in order to terminate the injection. This action is accomplished by arranging a mouth of the pressure channel 6 so that it emerges from the annular slide 8 during the compression stroke movement.

The fuel quantity is thus dependent on the position of the annular slide 8, which is adjustable, via a governor lever 12 supported at 11, by means of a hydraulic governor 13. The hydraulic governor 13 functions with an adjusting piston 14, one end face of which is exposed to the fuel from the suction chamber 5, and on the opposite end a spring unit 15 engages the piston, the forces of this spring unit 15 being arbitrarily variable. The suction chamber 5 receives the fuel from a supply pump 16, which is driven at a rotary speed synchronous with the pump (this drive generally being integrated in the pump), with the pressure in the suction chamber 5 being controlled via a pressure control valve 17 in accordance with rpm; that is, the pressure increases with increasing rpm.

A piston 18 of an injection time adjustment device is also under the influence of the suction chamber 5.

A discharge channel 19 branches off from the suction chamber 5 in the housing 1 and has an overflow valve 20 disposed therein which acts as a constant-flow valve. A throttle valve 21 may be disposed subsequent to this overflow valve 20 in order to exert an influence on the control pressure. The function of the overflow valve or of the subsequent throttle valve is as follows: The overflow quantity is controlled by means of the cross section x between the slide shaft and the bore y as a result of the hydraulic balance—that is, the ratio of pressure times surface area on the front face of the slide to the reduced pressure on the back face of the slide times the slide surface area plus the spring force.

The spring unit 15 is arranged to act counter to the hydraulic force that engages the piston 14 and may comprise one spring or a plurality of springs, which cooperate via spring plates and are advantageously disposed in series with respect to their function. In every case, the force of at least one spring can be varied by means of a coupler member 22 (FIG. 2), which (embodied here as a piston) is disposed coaxially with the actual adjusting piston in the housing 1 and is axially adjustable from outside the pump housing 1 by means of an adjusting lever shown in FIG. 2. After the coupler member 22 is removed, the spring unit 15 can be separated from the adjusting piston 14 in a very simple manner and then exchanged; or, with the same basic embodiment, different spring units can be assembled therewith. The adjusting piston 14 has a step or shelf area 23, which serves as a contact for a sleeve 24 with a spring plate, which is placed over the reduced or stub portion 25 of the adjusting piston 14. The spring plate cap 24 may be supported with its plate on the housing 1, however, in the illustrated example, it is supported on a bushing 26 attached to the housing. A starting spring 28 is disposed between the base 27 of the sleeve 24 and the end face of the stub portion 25 of the adjusting piston 14. When the engine is stopped, the starting spring 28 pushes the adjusting piston 14 and thus the stub portion 25 a predetermined distance out of the sleeve 24, whereby in turn the annular slide 8 of the injection pump is displaced to such an extent (to the right, as shown in the drawing) that the mouth of the pressure channel no longer emerges from the annular slide 8, accordingly, the entire fuel quantity supplied by the fuel injection pump is injected as a starting quantity. Then, as soon as the engine is started and a predetermined pressure has been established via the supply pump 16 in the suction chamber 5, the adjusting piston is pushed against the starting spring 28, until the shoulder 23 strikes the sleeve 24, which corresponds to the position of the annular slide 8 for full load.

The idling rpm is governed by an idling spring 29, which is supported at one end on the coupler member 22 and on the other end on an intermediate spring plate 30, which is supported in axially displaceable fashion in the direction of the force of the spring 29 on a spring plate bushing 30, which is likewise disposed in axially displaceable fashion in the same direction on the sleeve 24. The freedom of motion in the opposite direction is prevented in each case by a securing ring 32 that is disposed on the sleeve 24 and is adapted to abut the spring plate bushing 31. A governor spring 33 engages the side of the intermediate spring plate 30 remote from the idling spring 29 and is supported on the other end on the spring plate bushing 31. An adaptation spring 34 is disposed between the spring plate bushing 31 and the spring plate sleeve 24, with the travel path of the sleeve 24—that is, the variation of the force of the adaptation spring 34—being limited by a shoulder 35 provided on the spring plate bushing 31.

The governor functions as follows: After starting of the engine and the compression of the starting spring 28, and as long as the coupler member 22 is in the idling position corresponding to idling rpm, the adjusting piston 14, including the spring unit 15, is displaced toward the right and toward the coupler member 22 by the fuel pressure in the suction chamber 5. At the same time, the annular slide 8 is displaced toward the left, until the injection quantity effects an idling rpm which is governed by means of a remnant spring travel path of the idling spring 29 which has a degree of disuniformity which is as low as possible. In FIG. 1, the adjusting piston 14 assumes the position shown after starting, but before the displacement into the idling position. In contrast, the coupler member 22 is displaced out of the idling position toward the right, in the direction of the movement of the adjusting piston 14. That is, as soon as the adjusting piston 14 with the spring packet 15 has been displaced toward the right when there is sufficient pressure in the suction chamber 5, idling is no longer attained; instead, a fuel injection quantity is effected which corresponds to partial load. Now, as soon as the load on the engine decreases, the rpm and thus the pressure in the suction chamber 5 increases, and the adjusting piston 14 displaces the sleeve 24 and the spring plate bushing 31 toward the right against the force of the governor spring 33, which then causes a downward control of the fuel injection quantity. Depending upon how the coupler member 22 is displaced by the gas pedal, a different fuel injection quantity is thus established. For example, after exceeding the maximum permissible rpm, the spring 33 is compressed and a downward control of the fuel supply is effected accordingly. In FIG. 1, the spring unit 15 assumes the position for full load—that is, a position which is assumed during operation of the engine whenever it is brought about by means of the coupler member 22 when it is pushed against the spring plate 30 (full load position). This governor thus functions as an idling end governor, that is, a governor which governs solely the idling or final rpm. In the intermediate-load positions, the injection quantity is determined by the driver of the vehicle equipped with an engine having this device thereon. In the example shown in FIG. 1, the spring plate bushing 31 is supported in the full-load position on the bushing 26 that is associated with the housing 1, so that the adaptation spring 34 can be effective over the entire arbitrary adjustment range, and in particular at full load. That is, at full load, even when the spring plate bushing 31 is resting against the bushing 26 the cap 24 can travel the distance of an adaptation path before downward control occurs as a result of compression of the governor spring 33 (FIGS. 6 and 7).

The chamber 43 which encloses the spring unit 15, into which the coupler member 22 protrudes on one end and the adjusting piston 14 protrudes on the other end, is relieved of pressure toward the suction side of the low-pressure supply pump via a channel 36. In the governor in accordance with the invention, the principle of balance between the hydraulic pressure on one side and the spring forces on the other side is optimally attained by means of the favorable structural arrangement and the small structural space required. In accordance with the invention, the spring unit 15 also can be so embodied that the governor functions as an adjustment governor (FIGS. 2 and 3); that is, that a certain rpm of the engine corresponds to every position of the coupler member 22.

An additional opportunity for introducing an adjustment variable for load dependence into the control circuit is offered, as in the exemplary embodiment shown in FIG. 1, in that a portion of the fuel located in the suction chamber 5 flows out under load-dependent control, as a result of which the pressure also changes in a load-dependent manner. This causes, on the one hand, a corresponding change in the pressure exerted on the adjusting piston 14, and, on the other hand, a change in the adjustment variable of the piston 18. As a result, the onset of injection is changed in accordance with load. In order to control this outflow in an intended manner, an annular groove 37 is disposed in the adjusting piston 14, which cooperates with control openings 38 in the primary bushing 26 associated with the housing. The control openings 38 communicate with the suction chamber 5 via bores 39, an annular groove 40—each disposed in the bushing 26—and a bore 41. The annular groove 41 is connected by a channel 42 which extends within the adjusting piston 14 and is arranged to discharge on the spring side thereof with the chamber 43 which is relieved of pressure and encloses the spring unit 15. Depending upon the position of the adjustment piston 14, the annular groove 37 overlaps the control slits 38, which may be triangular in form, for example, to a greater or lesser extent. Because the position of the adjusting piston is load-dependent, the discharge cross section is accordingly likewise load-dependent. Accordingly, the pressure in the suction chamber 5 does not increase in proportion to the rpm, but rather, depending on the load, in somewhat less than proportional fashion as the load increases. The lower pressure thus resulting at maximum rpm can be compensated for accordingly on the part of the spring. This opportunity for a load-dependent adjustment in control is only one of various possibilities.

In order to enable a displacement by the governor lever 12 of the annular slide 8 in the direction of a shut-off of the engine independently of the position of the governor 13, the governor lever 12, on the side remote from the annular slide 8, engages a relatively wide annular groove 44 of the adjusting piston 14, with a play-compensating spring 45 being arranged to cause the governor lever 12 to be automatically coupled with the adjusting piston 14 only in the direction of downward control of the fuel supply. Accordingly, the governor lever 12 is arbitrarily adjustable only in this direction.

Figure 2:
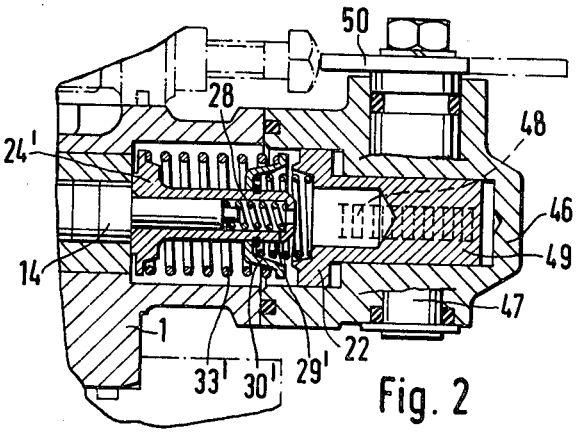

As is shown in FIG. 2, the coupler member 22 can be axially displaced via a gear, in that a shaft 47 supported in a cover 46 of the pump housing 1 has a pinion (not shown), which meshes with a rack 48, which is disposed on a shaft means 49 also supported in the cover 46. The shaft 47 is arbitrarily rotatable by an adjustment lever 50 connected to said shaft outside of the pump housing. The load is fed to the governor as a guide variable via this gear. This exemplary embodiment shown in FIG. 2, and in that of FIG. 3 as well, relates to an adjustment governor, that is, a governor in which the governor spring 33' effects rpm control over the entire rpm range, except at starting rpm levels or, in the case of the exemplary embodiment of FIG. 2, at ilding rpm levels. The characteristic and accordingly the characteristic curve of the governor spring 33' or 33'' are maintained such that depending on the load position of the coupler member 22—that is, depending on the initial tension of the governor spring—the fuel injection pump effects the downward control at a corresponding rpm. For full load, the governor spring 33' or 33'' is accordingly under greater initial tension from the coupler member 22, so that the adjusting piston 14 remains for a longer period in the illustrated position which corresponds to a large fuel quantity, until at an appropriate rpm a displacement of the spring plate sleeve 24' toward the right occurs for the purpose of rpm control, or until such displacement occurs upon exceeding the desired rpm for the purpose of downward control of the fuel supply. The idling control and other functions, of the intermediate plate 30' as well, correspond to the exemplary embodiment shown in FIG. 1.

Figure 3:
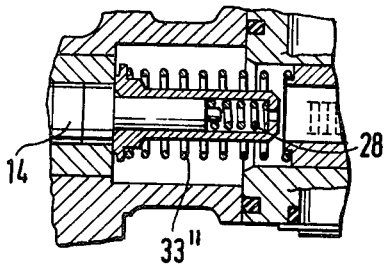
FIGS. 2 and 3 show schematic details of this pump, but with an adjusting governor.

In the exemplary embodiment shown in FIG. 3, the idling spring is omitted entirely. Instead, the governor spring 33'' also serves to govern idling. This type of adjustment governor is sufficient for simple engines making less stringent demands as to the quality of the control being performed.

These first three exemplary embodiments clearly show how, without altering most of the governor elements, such as the adjusting piston 14, coupler member 22, gears and the like, a multiplicity of governors can be attained with correspondingly low manufacturing expense, by means of simply exchanging different sets of spring elements.

The governor schematically shown in FIG. 4 corresponds in principle to the governor shown in FIG. 1. In contrast thereto, however, the spring plate bushing 31' is not supported on the housing 1, but is instead held in the illustrated position by the adaptation spring 34. As soon as the coupler member 22 is displaced to the left, as viewed in the drawing, in the full-load position, that is, as soon as it directly engages the intermediate spring plate 30 of the governor spring 33, the spring plate bushing 31' is pushed with its shoulder 35' against the plate of the sleeve 24, whereupon the adaptation spring 34 is correspondingly compressed. The situation is different in the partial-load range, in which the spring plate bushing 31' assumes the position relative to the sleeve 24 which is shown in FIG. 4, or some intermediate position which corresponds to the adaptation at a particular time. The advantage of this over the adaptation means shown in FIG. 1 is, in particular, that adaptation along the "natural" hydraulic full-load line is precluded.

In the diagram shown in FIG. 5, the injection quantity Q is plotted over the rpm n. The indices s, v, l represent, respectively, starting, full load, and idling; u stands for "lower" and o stands for "upper". At the starting rpm level $n_s$, the injection quantity $Q_s$ is injected, until upon exceeding the starting rpm the adjusting piston 14 compresses the starting spring 28 into the illustrated position, which corresponds to the downward control curve I. Subsequently, the idling spring 29 is compressed by the adjusting piston, which corresponds to one of the curves II, depending upon the position of the coupler member 22. The farther toward the right the coupler member 22 is located, the lower is the rpm and thus the lower is the idling rpm ($n_{lu}$), or the smaller is the fuel injection quantity $Q_l$. For governing the normal idling rpm, the curve I merges via a bend with curve II (corresponding to the first three curves II from the left), because the idling spring 29 and the starting spring 28 are switched in series one after the other in terms of their relative force.

The governor illustrated is an idling end governor; that is, in a relatively high rpm range (ca. 80%), the fuel injection quantity is determined solely by the gas pedal or more specifically by the coupler member 22. In this range, which corresponds to the curves III, an adjustment takes place via the adjustment spring 34; that is, the fuel quantity decreases for a certain position of the coupler member 22 (a particular load position) at increasing rpm. This is not true for full load, as is discussed above. The full-load quantity $Q_v$ remains identical over the entire adjustment range—that is, between the idling rpm and the maximum rpm. Curve IV shows that the adjustment spring 34 is rendered ineffective (is compressed), before the downward control spring 33 effects a downward control in accordance with curves V upon exceeding the maximum rpm. This maximum rpm corresponds to the upper full-load rpm $n_{vo}$. Curves II, III and V likewise merge via bends with one another, because the springs 29, 34 and 33 are switched in series one after another with respect to their relative force.

The governor shown in FIG. 6, in turn, functions in principle as an idling end governor like the governor shown in FIG. 1; however, in contrast thereto it has a parallel arrangement of the starting spring 28 relative to the idling spring 29. The spring plate sleeve 24' has an open end face, into which a projection 51 of the coupler member 22 is arranged to protrude. As a result, the starting spring 28 is switched parallel to the idling spring 29, so that when gas is fed, an increase of the spring forces which are characteristic for idling is attained. This has the advantage that the starting shutoff rpm can be varied from the outside by means of the gas pedal.

The diagram shown in FIG. 6 corresponds to that of FIG. 5, but relates to the exemplary embodiment shown in FIG. 6. As a result of the parallel switching of the starting spring 28 and the idling spring 29, a large number of starting shutoff rpm levels appear, depending upon the position of the coupler member 22. Because the idling spring 29 is first effective after the adjusting piston 14 makes contact with the sleeve 24', this great number of starting shutoff curves I merges with a correspondingly great number of idling curves II. The left-hand curves correspond to a position of the coupler member 22 which is more toward the right, while the right-hand curves correspond to a position of the coupler member 22 which is more toward the left, that is, a position corresponding more to partial load. As has already been discussed in connection with FIG. 1, an adjustment takes place in this instance in the full-load range as well, because the spring plate bushing 24', in the full-load position of the coupler member 22, rests against the housing 1 and thus still permits a travel path of the adjusting piston 14 against the force of the adjustment spring 34 for the adaptation. In accordance with the diagram of the adjustment curves II, a decreasing fuel quantity thus results even at full load when the rpm level is increasing, as an adaptation of the fuel quantity to the rpm. The downward control takes place in accordance with curve V, again as has been discussed above.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection pump for internal combustion engines having a housing provided with an rpm governor, said governor including an adjusting member having one portion arranged to actuate a fuel quantity control member of said pump and further is engaged by an rpm-dependent adjustment force counter to the force of at least two springs of unequal strength, a first of said springs being weaker over its entire stroke than the second of said springs, characterized in that said first spring functions as a starting spring and is supported on one end directly on said adjusting member and on the other end on an element adjustable in accordance with load, and said second spring functions as a governor spring and is arranged to engage said adjusting member via a spring plate sleeve supported in a starting position on said housing and guided on said adjusting member, said second spring acts as the main regulating spring and can be brought into functional connection with said adjusting member by means of said spring plate sleeve, which is disposed on said adjusting member such that said spring plate sleeve is displaceable by a first stop on said adjusting member and additionally has a part with which it can be brought into contact against a second stop formed by a spring plate bushing, and that said spring plate sleeve can be brought by means of said second spring at least indirectly to at least one of the first or second stops, whereupon one end of said second spring is supported at least indirectly by a coupler member adjustable arbitrarily in accordance with the desired load.

2. A fuel injection pump in accordance with claim 1, characterized in that said adjusting member and said coupler member are disposed coaxially relative to said second spring.

3. A fuel injection pump in accordance with claim 1, characterized in that an idling spring is disposed between said second spring, and said coupler member and further that an intermediate spring plate is disposed between said second spring and said idling spring and that only after compression of said idling spring, for instance via said coupler member, is said second spring actuated and, wherein said intermediate spring plate is at least indirectly guided on said spring plate sleeve and limited in its travel path in the direction in which the force of said second spring is exerted by a stop disposed on said spring plate sleeve.

4. A fuel injection pump in accordance with claim 3, characterized in that said idling spring is supported on said coupler member, and that said coupler member, after the compression of said idling spring, is arranged to engage the intermediate spring plate.

5. A fuel injection pump in accordance with claim 1, characterized in that said second spring associated with said governor is disposed in series with an adaptation spring which engages a spring plate bushing guided on said spring plate sleeve.

6. A fuel injection pump in accordance with claim 1, characterized in that said spring plate sleeve is disposed axially displaceably on a stub portion of said adjusting member and that said starting spring is confined by said spring plate sleeve and abuts said stub portion.

7. A fuel injection pump in accordance with claim 5, characterized in that said spring plate bushing includes a bore arranged to receive said adaptation spring, one end of said spring supported on said spring plate sleeve and the other end of said spring supported on a shoulder of said spring plate bushing.

8. A fuel injection pump in accordance with claim 7, characterized in that said spring plate bushing is supported at least in the starting position on the primary bushing so that upon compression of said second spring by said coupler member said adaptation spring remains unaffected.

9. A fuel injection pump in accordance with claim 7, characterized in that said housing further includes an arbitrarily rotatable shaft, an adjustment lever associated therewith, said adjustment lever arranged to place said second spring under greater initial tension and said adaptation spring is compressed so as to be ineffective.

10. A fuel injection pump in accordance with claim 6, characterized in that said starting spring is disposed parallel to said other springs and is supported on said coupler member at a position remote from said adjusting member.

11. A fuel injection pump in accordance with claim 6, characterized in that said starting spring is disposed in series with said other springs and is supported on a terminal end of said spring plate sleeve.

12. A fuel injection pump in accordance with claim 1, characterized in that said adjusting member is embodied in piston form and is exposed to fuel which is under rpm-dependent pressure and which serves to provide the adjustment force.

* * * * *